US005796391A

United States Patent [19]

Chiu et al.

[11] Patent Number: 5,796,391

[45] Date of Patent: Aug. 18, 1998

[54] SCALEABLE REFRESH DISPLAY CONTROLLER

[75] Inventors: Scott Chiu; Scott R. Novis, both of Tempe, Ariz.

[73] Assignee: Motorola, Inc., Schaumburg, Ill.

[21] Appl. No.: 740,050

[22] Filed: Oct. 24, 1996

[51] Int. Cl.[6] ..... G09G 5/00

[52] U.S. Cl. ..... 345/204; 345/127; 340/825.44

[58] Field of Search ..... 345/204, 213, 345/56, 127, 128, 129, 130, 131, 132, 185, 189, 190, 200; 340/825.44; 348/524, 536, 537, 541

[56] References Cited

U.S. PATENT DOCUMENTS

| | | | |
|---|---|---|---|
| 4,281,393 | 7/1981 | Gitelman et al. | 345/168 |
| 4,611,228 | 9/1986 | Machida et al. | 345/213 |
| 5,187,471 | 2/1993 | Wagai et al. | 340/825.44 |
| 5,233,345 | 8/1993 | Ide | 340/825.44 |
| 5,329,290 | 7/1994 | Schwarz et al. | 345/132 |
| 5,402,149 | 3/1995 | Amagami et al. | 345/132 |
| 5,548,324 | 8/1996 | Downs et al. | 345/189 |
| 5,568,134 | 10/1996 | Cannon et al. | 340/825.44 |
| 5,592,194 | 1/1997 | Nishikawa | 345/127 |

*Primary Examiner*—Richard A. Hjerpe
*Assistant Examiner*—Ricardo Osorio
*Attorney, Agent, or Firm*—Robert D. Atkins; Robert F. Hightower

[57] ABSTRACT

A display controller (112) reduces the power consumed in displaying a graphics image in a portable wireless communications device (100) when a graphics image is smaller than the size of the display (118). The number of rows and columns used to display the graphics image is counted by a decoder (108) which is a microcontroller used to operate the communications device (100). The decoder (108) provides the reduced row or column count to the display controller (112), which reduces the frequencies of clocks (PIXEL CLOCK, LINE PULSE, FRAME PULSE) used for timing data transfers to the display (118). Power is reduced by operating the display (118) at a lower frequency while acceptable frame refresh rates are maintained.

14 Claims, 2 Drawing Sheets

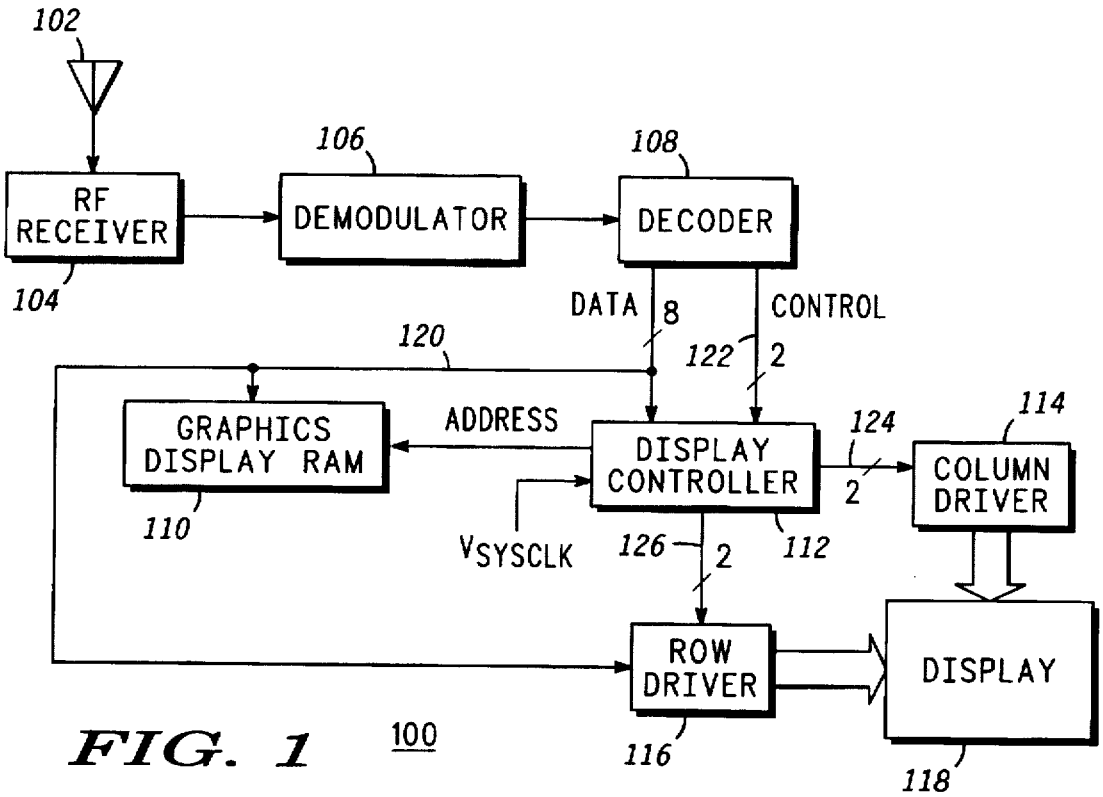
FIG. 1
FIG. 2
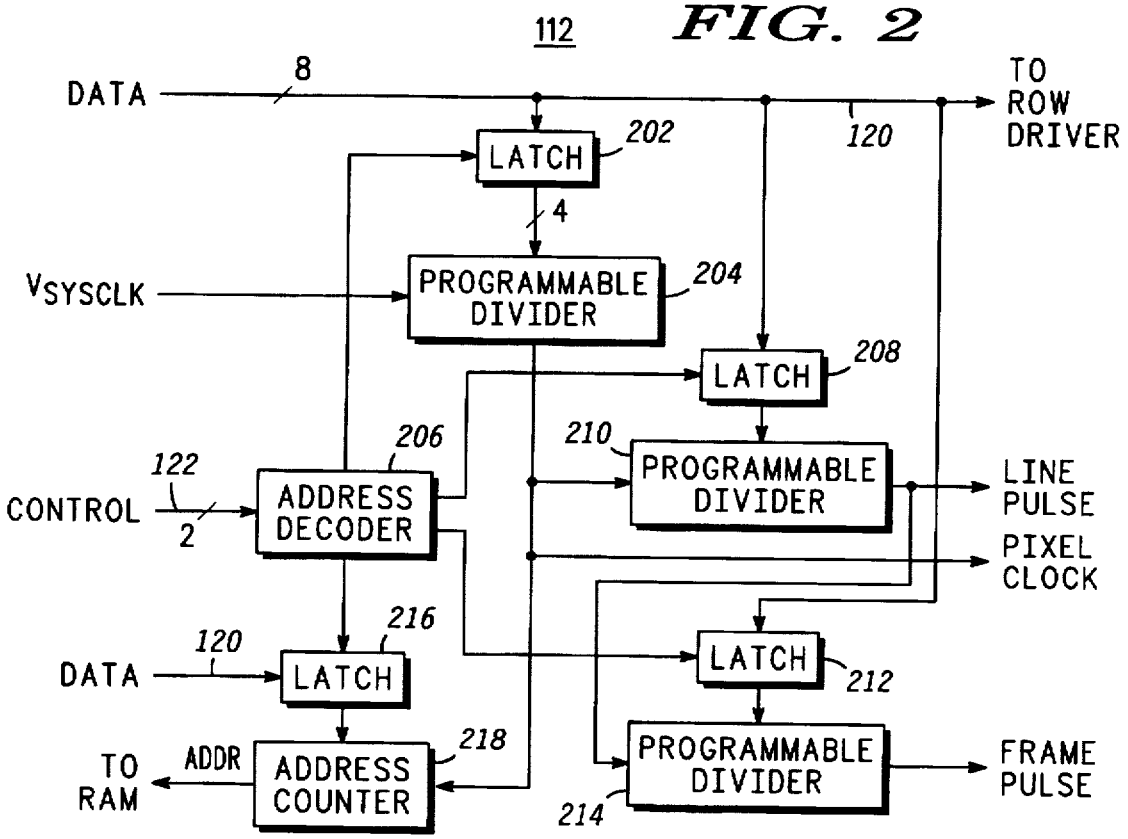

SCALEABLE REFRESH DISPLAY CONTROLLER

CROSS REFERENCE TO RELATED PATENT APPLICATIONS

The present application is related to copending U.S. patent application, Attorney's Docket No. SC09887C, entitled "DISPLAY DRIVER AND METHOD THEREOF," filed Oct. 24, 1996, U.S. patent Ser. No. 08/740,052, by Inventors Scott Chiu and Scott Novis; and patent application, Attorney's Docket No. SC09960C, entitled "NONLINEAR GRAY SCALE METHOD AND APPARATUS," filed Oct. 24, 1996, U.S. patent Ser. No. 08/740,055, by Inventors Scott Chiu, Karen Jachimowicz and George Kelly; and assigned to the same assignee, Motorola Inc.

BACKGROUND OF THE INVENTION

The present invention relates in general to display control circuits and more particularly to display control circuits in which the display is scaled down to fit an image.

Wireless communications devices typically receive a transmitted signal which contains information communicated to a user on a display. For example, a pager receives a transmitted signal modulated with digital data in a predefined format. A decoder in the pager is preprogrammed to recognize the predefined format and to perform computations on the digital data for recovering display and control data for operating the display.

The increasing functionality of pagers requires a graphics user interface (GUI) to make pagers easier to program and operate. A GUI includes a display controller which drives a high resolution light-emitting device (LED) display for viewing graphics images such as status icons and downloaded facsimile messages. A typical LED display is organized into a plurality of rows and columns. An image is displayed by scanning columns and activating rows to illuminate the pixels in the column.

Displaying graphics images requires the display controller to process and transfer large amounts of display and control data. A high frequency clock is needed for transferring data and for maintaining acceptable frame refresh rates for flicker-free display operation. However, high frequencies generate radio frequency interference and increase power consumption in the display and the display controller. The radio frequency interference lowers the performance of a portable wireless communications device while higher power consumption reduces the operating time between battery charges.

Hence a high resolution display controller is needed whose power consumption can be reduced while maintaining flicker-free frame refresh rates.

BRIEF DESCRIPTION OF THE DRAWINGS

FIG. 1 is a block diagram of a wireless communications device;

FIG. 2 is a block diagram of a display controller; and

DETAILED DESCRIPTION OF THE DRAWINGS

Figure 3:
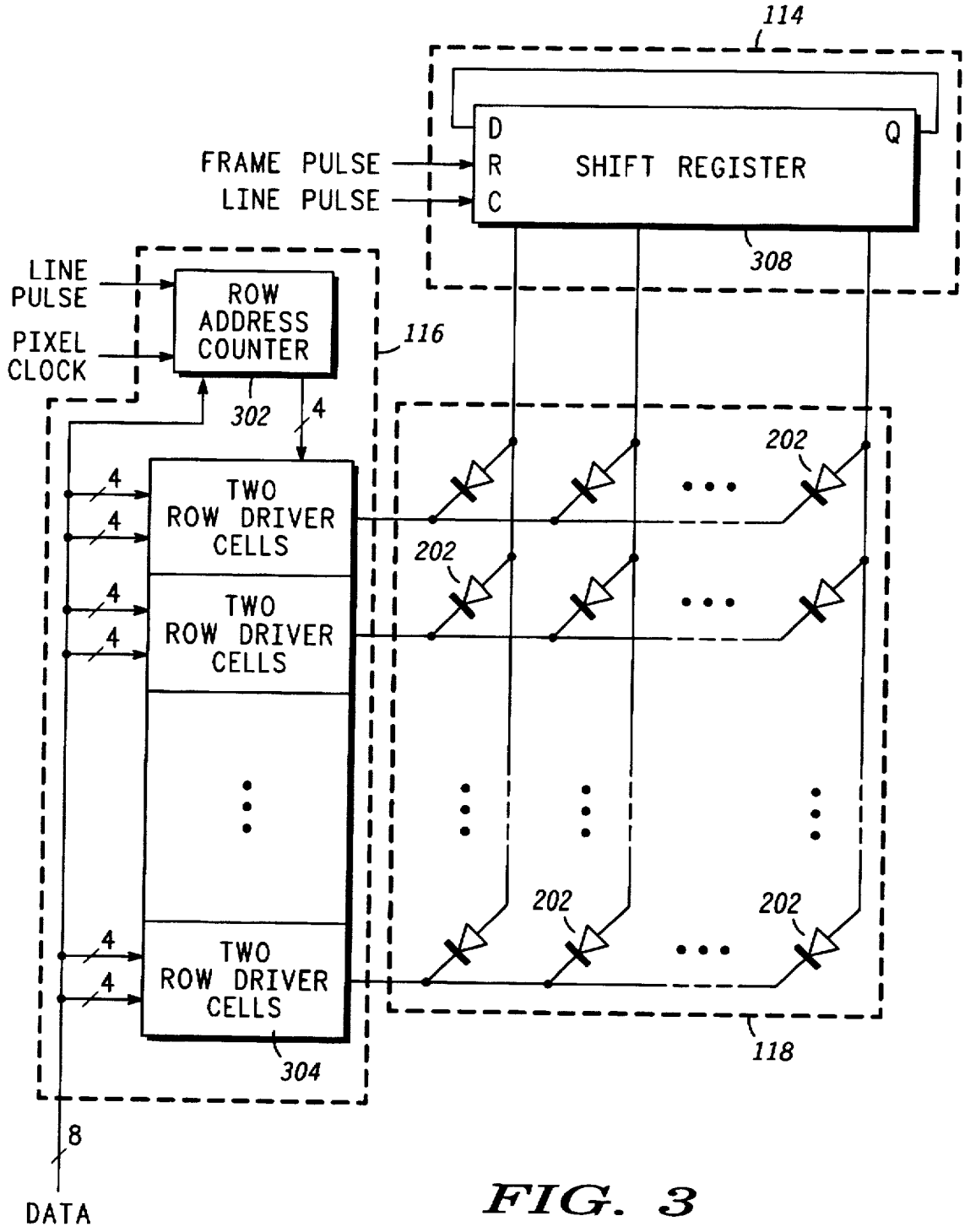
FIG. 3 shows a display with associated row and column drive circuitry.

FIG. 1 shows a block diagram of a portable wireless communications device 100, such as a pager or cellular telephone. Antenna 102 receives a transmitted radio frequency (RF) carrier signal modulated with digital data in a predefined format, including control data for operating communications device 100 and display data for viewing text and/or graphics images on a display 118. The RF carrier signal is coupled to RF receiver 104 for tuning and amplification. A demodulator 106 receives the amplified RF carrier signal and recovers a baseband digital data stream at its output.

Decoder 108 comprises a microcontroller which is preprogrammed to receive the baseband digital signal and to apply the predefined format to recover video and control components. The video component includes display data comprising a series of eight-bit luminance bytes. Each byte includes two four-bit luminance words which provide information for illuminating two pixels in display 118. The luminance bytes are provided on an eight-conductor bus 120 coupled to a graphics display random access memory (RAM) 110, a row driver 116 and a display controller 112. Although bus 120 is shown as an eight-conductor bus, it should be apparent that data can be provided on a wider or narrower bus as appropriate in a particular embodiment.

The control component includes end-of-line and end-of-frame synchronization signals for reproducing the image on display 118. As the baseband digital signal is processed, decoder 108 counts pixels until an end-of-line synchronization signal is received, thereby computing a pixel count, which represents the number of pixels in a line of the image. Decoder 108 counts lines of the image until an end-of frame signal is received for computing a line count which represents the number of lines in an image frame. The pixel count and line count are provided to display controller 112 on bus 120 accompanied by associated control signals provided on a two-conductor control bus 122. Decoder 108 divides the maximum number of pixels in a line, e.g., 72 pixels per line, by the pixel count to produce a pixel-rate divisor for adjusting the frequency of a PIXEL CLOCK used for timing data transfers on bus 120. Decoder 108 is also programmed to track where image data is stored in graphics display RAM 110 to provide efficient memory utilization.

Decoder 108 performs tasks in communications device 100 not related to displaying images, such as processing downloaded data and interpreting keypad commands. Many display functions are managed by display controller 112, while other control functions are provided by decoder 108. For example, display controller 112 provides incremental memory addresses to graphics display RAM 110 for storing or retrieving downloaded images, but the starting address is provided by decoder 108. A key function of display controller 112 is to minimize power consumption by dynamically adjusting the frequency of data transfers to operate display 118 at the lowest frequency which both reproduces the displayed image and refreshes display 118 at a flicker-free rate. Timing for display controller 112 is provided by a system clock $V_{SYSTEM}$ operating at a rate of 2.5 megahertz.

Display controller 112 generates a LINE PULSE and a FRAME PULSE on a two-conductor bus 124 which are coupled to column driver 114 for respectively scanning columns and refreshing display 118. A PIXEL CLOCK is produced on bus 126 for clocking display data to row driver 116. A LINE PULSE is generated at bus 126 for resetting row driver 116 to load display data in the first row of display 118.

Graphics display RAM 110 includes an array of read-write storage cells operating as a buffer for storing downloaded display data. Internal images such as status icons which are typically stored in read-only memory (not shown)

are also transferred to graphics display RAM 110 for easier accessibility. The timing of transfers of display data to and from graphics display RAM 110 is managed by display controller 112.

Display 118 comprises a matrix of light-emitting devices (LED) such as light-emitting diodes organized into a plurality of rows and columns to operate as pixels of display 118. In one embodiment of communications device 100, display 118 has 72 rows and 120 columns. The cathodes and anodes of the LED pixels are respectively connected to rows and columns in display 118 such that a unique LED pixel is illuminated when a column is selected and a row is activated. Rows and columns are respectively coupled to row and column inputs of display 118.

Column driver 114 has a plurality of outputs coupled to the column inputs of display 118 to operate in a column scan mode in which one column at a time is selected. Successive columns are selected by repetitively clocking column driver 114 with a LIME PULSE. When column driver 114 scans to the last display column of an image, a FRAME PULSE resets column driver 114 to cycle back to the first display column for refreshing display 118.

Row driver 116 has a plurality of outputs which operate in parallel to provide activating pulses to row inputs of display 118 for illuminating LED pixels in the selected column. The activating pulses drive LED pixels to a luminance level determined by four-bit luminance words. Pairs of luminance words are combined into an eight-bit luminance byte and serially clocked into respective pairs of individual cells of row driver 116 by PIXEL CLOCK. When all of the luminance words in a display column have been loaded, display controller 112 issues a LINE PULSE to cycle row driver 116 back to the first pair of cells to load new data.

FIG. 2 shows a block diagram of display controller 112 which is a clocking circuit including latches 202, 208, 212 and 216; programmable dividers 204,210 and 214; an address decoder 206 and an address counter 218. Display controller 112 sets the timing of data transfers among decoder 108, graphics display RAM 110 and row driver 116 in accordance with the size of the displayed image. Timing is varied by dynamically adjusting the frequency of PIXEL CLOCK and the periods of LINE PULSE and FRAME PULSE.

Address decoder 206 is a binary decoder which produces a load signal on one of four outputs by decoding a two-bit CONTROL signal from decoder 108. The load signals load data from bus 120 into one of the latches 202, 208, 212 and 216.

Latch 202 comprises a six-bit parallel-load, parallel output latch which operates in conjunction with programmable divider 204 to set the frequency of PIXEL CLOCK. PIXEL CLOCK determines the rate of data transfers into row driver 116. A CONTROL signal from decoder 108 is decoded by address decoder 206 to load the pixel-rate divisor from bus 120 into latch 202 for coupling to data inputs of programmable divider 204. Recall that the pixel-rate divisor is inversely related to the number of pixels in a column of the displayed image.

Programmable divider 204 comprises an initial divide-by-two stage which is clocked by system clock $V_{SYSCLK}$ to produce a divide-by-two clock signal at one-half of the $V_{SYSCLK}$ frequency. Programmable divider 204 further includes a free-running, six-bit parallel-load down counter which decrements on pulses from the divide-by-two clock signal to produce a PIXEL CLOCK pulse when the count reaches zero. After a PIXEL CLOCK pulse is produced, programmable divider 204 resets to the pixel-rate divisor to begin the next cycle. PIXEL CLOCK is therefore divided in frequency from $V_{SYSCLK}$ by a factor equal to the pixel-rate divisor. For example, when an image is displayed on all 72 pixels in a column, the pixel-rate divisor is 2 (72/36) so that PIXEL CLOCK has a frequency one-half that of $V_{SYSCLK}$, or 1.25 megahertz. If an image is displayed using say 24 pixels per column, the pixel-rate divisor is 6 (72/12) and PIXEL CLOCK has a frequency of (2.5 megahertz)/6=417 kilohertz, approximately. In short, the frequency of PIXEL CLOCK is reduced in proportion to the image size reduction.

Latch 208 comprises a four-bit parallel-load, parallel output latch which operates in conjunction with programmable divider 210 to define when a LINE PULSE is generated. A LINE PULSE clocks column driver 114 when a new column is selected, and is generated after luminance data has been serially loaded by PIXEL CLOCK into cells of row driver 116. A LINE PULSE is generated after all the pixels in a column have been loaded in row driver 116.

Programmable divider 210 comprises a free-running, four-bit parallel-load down counter. The pixel count is loaded from bus 120 into latch 208 in response to a load signal from address decoder 206, and coupled to a four-bit parallel input of programmable divider 210. Because two luminance words at a time are clocked into row driver 116, the value of the pixel count represents one-half the number of pixels of display data within a column. The pixel count thus ranges in value from 4 to 36. Programmable divider 210 decrements on pulses of PIXEL CLOCK and produces a LINE PULSE upon reaching a zero count. After a LINE PULSE is produced, programmable divider 210 resets to the pixel count and begins the next cycle.

Latch 212 comprises a four-bit parallel-load, parallel output latch which operates in conjunction with programmable divider 214 to control when a FRAME PULSE is generated. A FRAME PULSE resets column driver 114 to select the first column for refreshing display 118. The line count is loaded from bus 120 into latch 212 in response to a load signal from address decoder 206, and coupled to a four-bit parallel input of programmable divider 214. A FRAME PULSE is generated after column driver 114 has successively scanned all of the columns in the displayed image.

Programmable divider 214 comprises a free-running, four-bit parallel-load down counter. Programmable divider 210 decrements on repeated LINE PULSES to produce a FRAME PULSE when a zero count is reached. After a FRAME PULSE is produced, programmable divider 214 resets to the line count and begins the next cycle. FRAME PULSE is therefore divided in frequency from LINE PULSE by the line count stored in latch 202.

Most if not all logic families increase power consumption when the operating frequency increases. The power is typically consumed during logic level transitions when logic gates charge and discharge parasitic capacitances. Additional power is consumed by current spikes which are generated because of delays in turning off transistors in logic gates. When power is consumed at higher frequencies, more RF interference is generated. Besides system clock $V_{SYSCLK}$, PIXEL CLOCK operates at the highest dock frequency in communications device 100. Accordingly, PIXEL CLOCK is a source of substantial power consumption when operating at the 1.25 MHz frequency needed for driving display 118 in a full display mode. Smaller images, such as telephone numbers or status icons are fully displayed in fewer rows and columns of display 118 and require fewer data transfers between frame refreshes. If these smaller images are displayed using the maximum 1.25 MHz frequency of PIXEL CLOCK, power is unnecessarily wasted.

The present invention reduces overall power consumption by determining the size of an image and dynamically adjusting clock operating frequencies to transfer data at the lowest frequency that ensures an acceptable refresh rate. For a LED display or other zero persistence display, the minimum refresh rate for flicker-free operation has been determined to be 52.8 hertz. The frequency of PIXEL CLOCK and LINE PULSE are reduced when an image can be displayed with fewer pixels per line, i.e., on fewer rows. The frequency of FRAME PULSE is reduced when the image is displayed using fewer columns. By way of example, for a minimum image size having a square whose dimension is eight pixels on a side, the frequency of PIXEL CLOCK is reduced to approximately (1.25 MHz)/9=137 kilohertz.

Latch 216 comprises an eight-bit parallel-load, parallel output latch which operates in conjunction with address counter 218 to provide addresses to graphics display RAM 110 for storing luminance bytes. The starting address for the first luminance byte is provided by decoder 108 to provide ready access to recently displayed images in order to minimize power consuming data transfers. The starting address is loaded from bus 120 into latch 216 and coupled to address counter 218 by a load pulse from address decoder 206. Successive luminance bytes are stored at incremental addresses generated by address counter 218 in response to PIXEL CLOCK. Address counter 218 is an eight-bit, parallel-load up counter which has a capacity to generate 256 unique addresses. For images requiring more address space, luminance data can be stored in 256-address pages, where a page address is produced in decoder 108 and coupled on bus 120 directly to graphics display RAM 110.

Referring to FIG. 3, a diagram of display 118 is shown being driven by row and column drivers 116 and 114, respectively. Display 118 comprises a LED matrix coupled to 72 rows and 120 columns to operate each LED as a display pixel. A LED pixel is illuminated when its associated column is selected and its row is driven by an activating signal.

Column driver 114 includes a 120-stage shift register 308 having a feedback output at the last stage coupled to the data input of the first stage to operate shift register 308 as a ring counter. The FRAME PULSE is applied at an input for initializing shift register 308 to produce a column enable signal at the output of the first stage for selecting the first column. The LINE PULSE repetitively applied to the clock input of shift register 308 clocks the column enable signal through successive stages to operate display 118 in a column scan mode.

When display 118 is operating such that all 120 columns are used for displaying an image, shift register 308 operates as a ring counter which shifts the column select signal from the last stage (stage 119) back to the first stage (stage 0) through the feedback output. When the image is displayed on fewer than 120 columns, the FRAME PULSE is produced after the last column has been selected, thereby reinitializing shift register 308 and selecting the first column. For example, if columns 0 through 19 are used for displaying an image, shift register 308 repetitively selects columns 0 through 19. On the next clock cycle, the FRAME PULSE is applied by display controller 112, which initializes shift register 308 and selects column 0 again. Instead of scanning all 120 columns, column driver 114 scans only columns 0–19 needed for displaying the image. The frequencies of the LINE PULSE and FRAME PULSE are therefore reduced accordingly. In an alternative embodiment, shift register 308 includes parallel inputs which load data representative of a starting column in response to the FRAME PULSE to display an image at any column of display 118.

Row driver 116 comprises a row address counter 302 and a stack of 72 row driver cells 304. Row address counter 302 is a six-stage binary up counter which applies a six-bit row address signal to the 72 row driver cells 304. Pairs of adjacent row driver cells 304 have the same row address such that a row address selects two row driver cells 304 at a time. The LINE PULSE initializes row address counter 302 to select the first pair of row driver cells 304 at address zero (binary 000000). Repetitive pulses of PIXEL CLOCK increment row address counter 302 through row addresses from 0 to 35 and then cycle back to 0.

Each row driver cell 304 includes a row address decoder for decoding the six-bit row address. An eight-bit luminance byte comprising two four-bit luminance words is applied at data inputs of row driver 116. Each of the luminance words is loaded into a row driver cell 304 at the current row address in response to PIXEL CLOCK. A luminance word is representative of a luminance level in a pixel of the displayed image.

Row driver cell 304 has an output coupled to a row input of display 118. The output provides an activating signal for illuminating a LED pixel in the selected column. Row driver cell 304 comprises a flip-flop which is clocked by the LINE PULSE to load a luminance bit and initiate the activating signal as determined by the value of the luminance bit. Alternatively, gray scale pixel shading is provided by a digital-to-analog converter (not shown) whose output provides the activating signal having an amplitude determined by the value of the luminance word. The amplitude of the activating signal defines a current in the LED pixel for producing a variable luminance.

In yet another embodiment, row driver cell 304 uses PIXEL CLOCK or another clock signal to increment a programmable pulsewidth counter (not shown) to the value of the luminance word. The activation signal provided at the output of the programmable pulsewidth counter has a constant amplitude but a variable pulsewidth as determined by the luminance word. Table 1 shows the pulsewidth of the activating signal for each value of the luminance word in an embodiment of row driver cell 304, assuming a 140 microsecond LINE PULSE period.

TABLE 1

| Value of Luminance Word | Period of Activating Pulse (microseconds) |
|---|---|
| 0000 | 0.0 |
| 0001 | 8.7 |
| 0010 | 17.4 |
| 0011 | 26.1 |
| 0100 | 34.8 |
| 0101 | 43.5 |
| 0110 | 52.2 |
| 0111 | 60.9 |
| 1000 | 69.6 |
| 1001 | 78.3 |
| 1010 | 87.0 |
| 1011 | 95.7 |
| 1100 | 104.4 |
| 1101 | 113.1 |

TABLE 1-continued

| Value of Luminance Word | Period of Activating Pulse (microseconds) |
|---|---|
| 1110 | 121.8 |
| 1111 | 130.5 |

The LED pixel produces a constant luminance for a variable period of time. The pulsewidth modulated luminance is integrated by the human eye, which perceives the LED pixel as having a variable shading.

In full display mode, 36 pulses of PIXEL CLOCK increment row address counter 302 to count row addresses from 0–35. Where the image size is reduced, a LINE PULSE reinitializes row address counter 302 to a zero count after loading a luminance word into the last row of the displayed image. For example, if an image is displayed using 40 rows, i.e., 20 row addresses, then row address counter 302 counts from 0–19 and a LINE PULSE reinitializes row address counter 302 back to a 0 count.

The present invention thereby provides a display controller for displaying a graphics image in a portable wireless communications device which operates at a reduced power level. The number of rows and columns in the displayed graphics image is counted by a decoder, which provides line and frame counts to the display controller for adjusting the period of a LINE PULSE and a FRAME PULSE to correspond to the image size. The decoder produces a pixel-rate divisor which is loaded into a binary counter in the display controller to reduce the frequency of the PIXEL CLOCK when fewer data transfers are needed to display the image.

By continuously monitoring the number of rows and columns in the displayed image, the present invention is able to dynamically adjust the PIXEL CLOCK, LINE PULSE and FRAME PULSE frequencies to the lowest value which allows the image to be displayed without display flicker. The reduced frequency operation reduces the power consumed by column driver 114 and row driver 116 during logic level transitions resulting from current spikes in the logic gates and the charging and discharging of parasitic voltages. Besides extending battery operating time, the reduced frequencies improve the performance of the portable wireless communications device by reducing RF interference.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. A wireless communications device for viewing an image on a display, comprising:

a radio frequency (RF) circuit having an input coupled for receiving a RF input signal and an output;

a demodulator having an input coupled to the output of the RF circuit and having an output for providing a baseband data signal;

a decoder circuit having an input for receiving the baseband data signal for providing image data, where the decoder circuit counts a number of pixels within a line of the image data to produce a pixel count and divides a number of pixels within a line of the display by the pixel count to compute a pixel rate divisor;

a circuit for clocking the display, including (1) a first divider having a clock input for receiving a clock signal, a data input for receiving the pixel rate divisor, and an output for providing a pixel clock for transferring the image data to the display; and (2) a second divider having a clock input for receiving the pixel clock, a data input for receiving the pixel count, and an output for providing a line clock having a substantially constant period as a period of the pixel clock varies.

2. A clocking circuit for driving a display device, comprising:

a decoder circuit having an input for receiving a data stream and an output for providing image data, the decoder circuit counting a number of pixels within a line of the image data to produce a pixel count and dividing a number of pixels within a line of the display device by the pixel count to compute a pixel rate divisor;

a first divider having a clock input for receiving a clock signal, a data input for receiving the pixel rate divisor, and an output for providing a pixel clock for transferring the image data; and a second divider having a clock input for receiving the pixel clock, a data input for receiving the pixel count, and an output for providing a line clock having a substantially constant period as a period of the pixel clock varies.

3. The clocking circuit of claim 2, wherein the decoder circuit counts a number of lines within a frame of the image data to produce a line count.

4. The clocking circuit of claim 3, further comprising a third divider having a clock input for receiving the line clock, a data input for receiving the line count, and an output for providing a frame clock.

5. The clocking circuit of claim 2, wherein the first divider includes:

a first latch having a first input for receiving the pixel rate divisor from the decoder circuit, and a second input coupled for receiving a first control signal to latch the pixel rate divisor at an output; and a first binary counter having an input coupled to the output of the first latch for counting to the pixel rate divisor to produce the pixel clock.

6. The clocking circuit of claim 5, wherein the second divider comprises:

a second latch having a first input for receiving the pixel count from the decoder circuit, and a second input coupled for receiving a second control signal to latch the pixel count at an output; and a second binary counter having an input coupled to the output of the second latch for counting to the pixel count to produce the line clock.

7. The clocking circuit of claim 4, wherein the third divider comprises:

a third latch having a first input for receiving the line count from the decoder circuit, and a second input coupled for receiving a third control signal to latch the line count at an output; and a third binary counter having an input coupled to the output of the third latch for counting to the line count to produce the frame clock.

8. The clocking circuit of claim 7, further comprising:

a fourth latch having a first input coupled for receiving a starting address from the decoder circuit and a second input coupled for receiving a fourth control signal to latch the starting address at an output; and an address counter having a data input coupled to the output of the fourth latch, a clock input coupled for receiving the pixel clock and an output for providing a memory address for storing the image data.

9. The clocking circuit of claim 8, further comprising an address decoder having an input coupled to the decoder circuit for receiving control data, and decoding the control data to provide the first through fourth control signals at first through fourth outputs, respectively.

10. A method of clocking a display, comprising the steps of:

counting a number of pixels within a line of the image data to produce a pixel count;

dividing a number of pixels within a line of the display by the pixel count to compute a pixel rate divisor;

counting a system clock to the pixel rate divisor to produce a pixel clock for transferring the image data; and counting the pixel clock to the pixel count to produce a line clock having a substantially constant period as a period of the pixel clock varies.

11. The method of claim 10, further comprising the step of counting a number of lines within a frame of the image data to produce a line count.

12. The method of claim 11, further comprising the step of counting the line clock to the line count to produce a frame clock.

13. The method of claim 12, wherein the step of counting the system clock includes the step of latching the pixel rate divisor.

14. The method of claim 13, wherein the step of counting the pixel clock includes the step of latching the pixel count, and the step of counting the line clock includes the step of latching the line count.

* * * * *